US009877366B2

(12) United States Patent
Xie

(10) Patent No.: US 9,877,366 B2
(45) Date of Patent: Jan. 23, 2018

(54) LIGHT-EMITTING DIODE DIMMING DRIVER CIRCUIT

(71) Applicants: BOE TECHNOLOGY GROUP CO., LTD., Beijing (CN); BOE OPTICAL SCIENCE AND TECHNOLOGY CO., LTD., Jiangsu (CN)

(72) Inventor: Wei Xie, Beijing (CN)

(73) Assignees: BOE TECHNOLOGY GROUP CO., LTD. (CN); BOE OPTICAL SCIENCE AND TECHNOLOGY CO., LTD. (CN)

( * ) Notice: Subject to any disclaimer, the term of this patent is extended or adjusted under 35 U.S.C. 154(b) by 0 days.

(21) Appl. No.: 15/301,767

(22) PCT Filed: Jan. 4, 2016

(86) PCT No.: PCT/CN2016/070010
§ 371 (c)(1),
(2) Date: Oct. 4, 2016

(87) PCT Pub. No.: WO2017/031919
PCT Pub. Date: Mar. 2, 2017

(65) Prior Publication Data

US 2017/0188428 A1 Jun. 29, 2017

(30) Foreign Application Priority Data

Aug. 21, 2015 (CN) ..... 2015 1 0516167

(51) Int. Cl.
*H05B 37/00* (2006.01)
*H05B 33/08* (2006.01)

(52) U.S. Cl.
CPC ..... *H05B 33/0845* (2013.01); *H05B 33/089* (2013.01); *H05B 33/0815* (2013.01)

(58) Field of Classification Search
CPC .... H05B 41/34; H05B 33/0803; H05B 39/09; H05B 41/28; H05B 33/0809;
(Continued)

(56) References Cited

U.S. PATENT DOCUMENTS

2011/0193488 A1 8/2011 Kanamori et al.
2012/0235597 A1* 9/2012 Nerone ..... H02M 1/44 315/297

(Continued)

FOREIGN PATENT DOCUMENTS

CN 203219540 U 9/2013
CN 103491665 A 1/2014

(Continued)

OTHER PUBLICATIONS

First Office Action for Chinese Application No. 201510516167.8, dated Feb. 23, 2017, 11 Pages.
International Search Report and Written Opinion for Application No. PCT/CN2016/070010, dated Apr. 29, 2016, 13 Pages.

(Continued)

*Primary Examiner* — Minh D A
(74) *Attorney, Agent, or Firm* — Brooks Kushman P.C.

(57) ABSTRACT

The present disclosure provides an LED dimming driver circuit, which includes: a TRIAC dimmer configured to adjust an inputted alternating voltage; and a RCC connected to the TRIAC dimmer and configured to adjust the alternating voltage from the TRIAC dimmer to provide a driving current for an LED load.

20 Claims, 6 Drawing Sheets

(58) Field of Classification Search
CPC ..... H05B 41/295; H05B 41/2827; H05B 41/3925; H05B 33/0815; H05B 33/0818; H05B 41/2828; H05B 41/3921; H05B 41/3927; Y02B 20/202
See application file for complete search history.

(56) References Cited

U.S. PATENT DOCUMENTS

| | | | | |
|---|---|---|---|---|
| 2013/0127353 | A1* | 5/2013 | Athalye ..... | H05B 33/0815 315/193 |
| 2014/0055055 | A1* | 2/2014 | Melanson ..... | H02M 3/335 315/228 |
| 2015/0146461 | A1 | 5/2015 | Deng et al. | |
| 2015/0173153 | A1 | 6/2015 | Hsiu et al. | |
| 2016/0021711 | A1 | 1/2016 | Chen | |

FOREIGN PATENT DOCUMENTS

| | | | |
|---|---|---|---|
| CN | 103607825 | A | 2/2014 |
| CN | 203467008 | U | 3/2014 |
| CN | 104244514 | A | 12/2014 |
| CN | 204362379 | U | 5/2015 |
| CN | 104717795 | A | 6/2015 |
| CN | 104797044 | A | 7/2015 |
| CN | 204559957 | U | 8/2015 |
| CN | 105101556 | A | 11/2015 |

OTHER PUBLICATIONS

Second Office Action for Chinese Application No. 201510516167.8, dated Jul. 31, 2017, 8 Pages.

* cited by examiner

LIGHT-EMITTING DIODE DIMMING DRIVER CIRCUIT

CROSS-REFERENCE TO RELATED APPLICATIONS

This application is the U.S. national phase of PCT Application No. PCT/CN2016/070010 filed on Jan. 4, 2016, which claims priority to Chinese Patent Application No. 201510516167.8 filed on Aug. 21, 2015, the disclosures of which are incorporated in their entirety by reference herein.

TECHNICAL FIELD

The present disclosure relates to the field of light-emitting diode (LED) dimming technology, in particular to an LED dimming driver circuit.

BACKGROUND

A triode-for-alternating-current (TRIAC) dimmer may be achieved merely by a TRIAC thyristor, and as compared with the other dimmers, it is simple and cheap, so it has been widely used nowadays.

In the case that an LED lamp is used to replace an incandescent lamp for illumination, it is necessary to provide a peripheral circuit capable of being compatible with the TRIAC dimmer.

However, the conventional peripheral circuit suitable for the TRIAC dimmer has a complex structure and low conversion efficiency. In addition, there are issues of dimming performances, such as bad dimming linearity, narrow dimming range and flickering.

SUMMARY

A main object of the present disclosure is to provide an LED dimming driver circuit, so as to simply a circuit structure, thereby to be compatible with a TRIAC dimmer.

The present disclosure provides in some embodiments an LED dimming driver circuit, including: a TRIAC dimmer configured to adjust an inputted alternating voltage; and a ringing choke converter (RCC) connected to the TRIAC dimmer and configured to adjust the alternating voltage from the TRIAC dimmer to provide a driving current for an LED load.

Optionally, the RCC at least includes: a rectifier circuit configured to rectify the alternating voltage from the TRIAC dimmer into a direct voltage; a filter circuit configured to filter the direct voltage; and a power conversion circuit configured to perform power conversion on the filtered direct voltage, to filter out an alternating voltage component from the filtered direct voltage, thereby to provide the driving current for the LED load.

Optionally, the RCC further includes a first passive bleeder circuit arranged between the TRIAC dimmer and the rectifier circuit and configured to perform a passive bleeding operation on the alternative voltage from the TRIAC dimmer.

Optionally, the rectifier circuit includes a first alternating voltage input end and a second alternating voltage input end, and the alternating voltage from the TRIAC dimmer is inputted via the first alternating voltage input end and the second alternating voltage input end. The first passive bleeder circuit includes: an input resistor, a first end of which is connected to the first alternating voltage input end; and an input capacitor, a first end of which is connected to a second end of the input resistor, and a second end of which is connected to the second alternating voltage input end.

Optionally, the input resistor has a resistance ranging from 500Ω to 5000Ω, and the input capacitor has a capacitance ranging from 47 nF to 220 nF.

Optionally, the RCC further includes a second passive bleeder circuit arranged between the rectifier circuit and the filter circuit and configured to perform a passive bleeding operation on the direct voltage from the rectifier circuit.

Optionally, the rectifier circuit includes a first direct voltage output end and a second direct voltage output end, and the direct voltage rectified by the rectifier circuit is outputted via the first direct voltage output end and the second direct voltage output end. The second passive bleeder circuit includes a pi-type filter. The pi-type filter includes: a first output capacitor connected between the first direct voltage output end and the second direct voltage output end; a first differential mode (DM) inductor, a first end of which is connected to the first direct voltage output end; and a second output capacitor, a first end of which is connected to a second end of the DM inductor, and a second end of which is connected to the second direct voltage end.

Optionally, the first output capacitor and the second output capacitor each have a capacitance ranging from 90 nF to 110 nF.

Optionally, the rectifier circuit includes a rectifier bridge. The rectifier bridge includes: a first rectifier diode, an anode of which is connected to the first alternating voltage input end, and a cathode of which is connected to the first direct voltage output end; a second rectifier diode, an anode of which is connected to the second alternating voltage input end, and a cathode of which is connected to the cathode of the first rectifier diode; a third rectifier diode, an anode of which is connected to the second direct voltage output end, and a cathode of which is connected to the cathode of the second rectifier diode; and a fourth rectifier diode, an anode of which is connected to the anode of the third rectifier diode, and a cathode of which is connected to the anode of the first rectifier anode.

Optionally, the filter circuit includes: a filtration DM inductor, a first end of which is connected to a second end of the first DM inductor, and a filtration electrolytic capacitor, a positive plate of which is connected to a second end of the filtration DM inductor, and a negative plate of which is connected to the second direct voltage output end.

Optionally, the filtration DM inductor has an inductance ranging from 1 mH to 2 mH, and the filtration electrolytic capacitor has a capacitance ranging from 0.68 μF to 2.2 μF.

Optionally, the RCC further includes a power supply loop. The power supply loop includes: a starting unit connected to the filter circuit and configured to convert the direct voltage filtered by the filter circuit into a starting voltage; and a driving unit connected to the starting unit and the LED load and configured to perform positive feedback self-excited oscillation in accordance with the starting voltage, so as to provide the driving current for the LED load.

Optionally, the driving unit includes a power-supply diode, a first switch transistor, a positive feedback current conversion module, and a transformer having a primary winding and a secondary winding. A cathode of the power-supply diode is connected to the second end of the filtration DM inductor and an anode of the LED load. A control electrode of the first switch transistor is connected to the second end of the filtration DM inductor through the starting unit, a first electrode thereof is connected to an anode of the power-supply diode, and a second electrode thereof is connected to the second direct voltage output end. A first end of the primary winding is connected to a cathode of the LED load, and a second end thereof is connected to the first electrode of the first switch transistor. A first end of the secondary winding is connected to the control electrode of the first switch transistor through the positive feedback current conversion module, and a second end thereof is grounded. The positive feedback current conversion module is configured to convert an induced electromotive force generated by the secondary winding into a positive feedback current, and input the positive feedback current to the control electrode of the first switch transistor. In the case that the first switch transistor is turned on, the primary winding is configured to provide the driving current to the LED load through the first switch transistor and the filtration electrolytic capacitor, and in the case that the first switch transistor is turned off, the primary winding is configured to provide the driving current to the LED load through the power-supply diode.

Optionally, the starting unit includes a first resistor module, and the driving unit further includes a second resistor module connected between the second electrode of the first switch transistor and the second direct voltage output end.

Optionally, the positive feedback current conversion module includes: a feedback resistor, a first end of which is connected to the first end of the secondary winding; and a feedback capacitor, a first end of which is connected to a second end of the feedback resistor, and a second end of which is connected to the control electrode of the first switch transistor. The power-supply loop further includes a transmission capacitor, and the second end of the secondary winding is grounded through the transmission capacitor.

Optionally, the positive feedback current conversion module further includes a feedback diode, an anode of which is connected to the control electrode of the first switch transistor, and a cathode of which is connected to the first end of the feedback capacitor.

Optionally, the power-supply loop further includes a current-limiting protection unit connected to the first end of the secondary winding and the control electrode of the first switch transistor, and configured to control the first switch transistor to be in an off state in the case that a potential at the first end of the secondary winding is greater than a predetermined value, so as to limit a load current.

Optionally, the current-limiting protection unit includes a second switch transistor, a voltage-stabilizing diode, a current-limiting diode, a current-limiting capacitor and a current-limiting resistor. A first end of the current-limiting resistor is connected to the first end of the secondary winding. An anode of the current-limiting diode is connected to a second end of the current-limiting resistor. A cathode of the voltage-stabilizing diode is connected to a cathode of the current-limiting diode. A first end of the current-limiting capacitor is connected to the anode of the current-limiting diode, and a second end thereof is connected to the second electrode of the first switch transistor. A control electrode of the second switch transistor is connected to an anode of the voltage-stabilizing diode, a first electrode thereof is connected to the control electrode of the first switch transistor, and a second electrode thereof is connected to the second direct voltage output end.

Optionally, the power protection circuit includes a power protection electrolytic capacitor and a power protection resistor connected in parallel between the anode of the LED load and the cathode of the LED load.

Optionally, the power protection electrolytic capacitor has a capacitance ranging from 82 μF to 220 μF.

As compared with the related art, the LED dimming driver circuit in the embodiments of the present disclosure includes the RCC for the LED dimming. Because the RCC is a self-excited topology-driven circuit, as compared with a conventional separately-excited circuit, the RCC is simple and cheap and has high conversion efficiency. In addition, due to its characteristics, it is able for the RCC to convert, in a nearly linear manner, a change in an input voltage applied to the TRIAC dimmer into a change in an output current. The starting voltage desired for the RCC is usually very low, and even in the case that the inputted alternating voltage is very low, the RCC may operate normally too. As a result, it is able to increase a dimming range.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
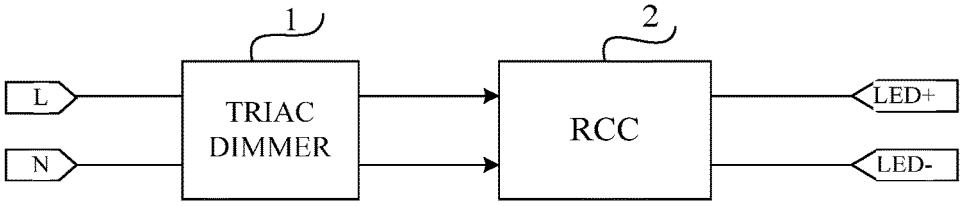
FIG. 1 is a block diagram of an LED dimming driver circuit according to one embodiment of the present disclosure.

As shown in FIG. 1, the present disclosure provides in some embodiments an LED dimming driver circuit, which includes: a TRIAC dimmer 1 configured to adjust an inputted alternating voltage; and a RCC 2 connected to the TRIAC dimmer 1 and configured to adjust the alternating voltage from the TRIAC dimmer 1 so as to provide a driving current for an LED load.

In FIG. 1, a reference sign L represents a live line for a mains supply capable of providing an alternating voltage, and a reference sign N represents a neutral line for the mains supply. The TRIAC dimmer 1 and the RCC 2 each have two input ends and two output ends. To be specific, a first input end of the TRIAC dimmer 1 is connected to the live line L, a second input end thereof is connected to the neutral line N, a first output end is connected to a first input end of the RCC 2, and a second output end thereof is connected to a second input end of the RCC 2. A first output end of the RCC 2 is connected to an anode (LED+) of the LED load, and a second output thereof is connected to a cathode (LED−) of the LED load.

According to the LED dimming driver circuit in the embodiments of the present disclosure, the RCC is used to regulate the alternating voltage from the TRIAC dimmer, so as to simplify the circuit structure for regulating the alternating voltage from the TRIAC dimmer.

To be specific, the RCC is used for the LED dimming. Because the RCC is a self-excited topology-driven circuit, as compared with a conventional separately-excited circuit, the RCC is simple and cheap and has high conversion efficiency. In addition, due to its characteristics, it is able for the RCC to convert, in a nearly linear manner, a change in an input voltage applied to the TRIAC dimmer into a change in an output current. The starting voltage desired for the RCC is usually very low, and even in the case that the inputted alternating voltage is very low, the RCC may operate normally too. As a result, it is able to increase a dimming range.

Figure 2:
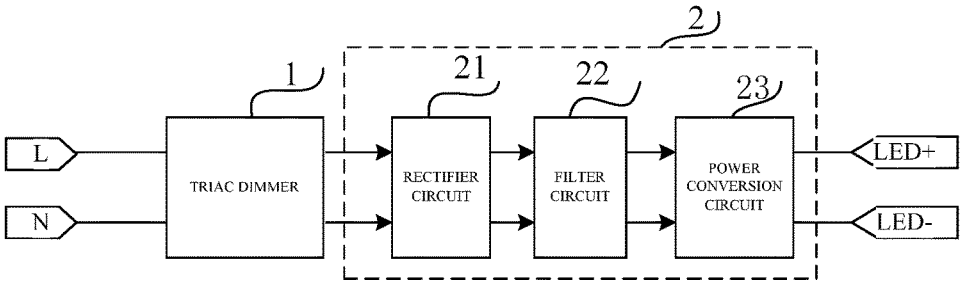
FIG. 2 is another block diagram of the LED dimming driver circuit according to one embodiment of the present disclosure.

To be specific, as shown in FIG. 2, the RCC 2 at least includes: a rectifier circuit 21 configured to rectify the alternating voltage from the TRIAC dimmer 1 into a direct voltage; a filter circuit 22 configured to filter the direct voltage; and a power conversion circuit 23 configured to perform power conversion on the filtered direct voltage, so as to filter out an alternating voltage component from the filtered direct voltage, thereby to provide the driving current for the LED load.

During the actual operation, the rectifier circuit 21 may rectify the alternating voltage from the TRIAC dimmer 1 into the direct voltage. Then, the direct voltage may be filtered by the filter circuit 22 and converted by the power conversion circuit 23, so as to obtain the direct voltage with the alternating voltage component being substantially filtered out. And then, the driving current may be provided for the LED load in accordance with the direct voltage.

Figure 3A:
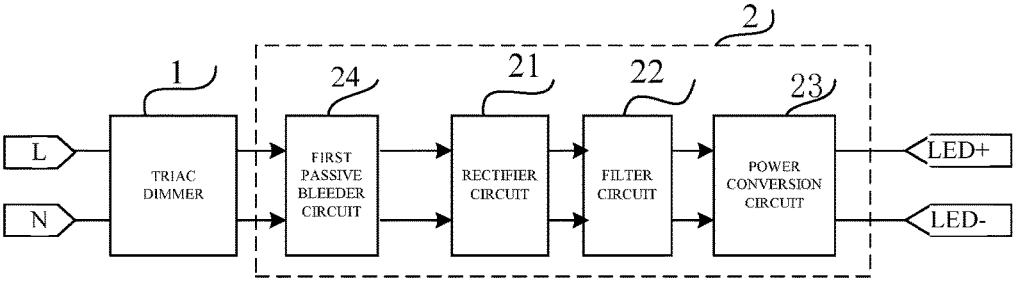
FIG. 3A is yet another block diagram of the LED dimming driver circuit according to one embodiment of the present disclosure.

As shown in FIG. 3A, the RCC 2 further includes a first passive bleeder circuit 24 arranged between the TRIAC dimmer 1 and the rectifier circuit 21 and configured to perform a passive bleeding operation on the alternative voltage from the TRIAC dimmer 1.

In the embodiments of the present disclosure, through the first passive bleeder circuit 24 added between the TRIAC dimmer 1 and the rectifier circuit 21, it is able to provide a stable current for the LED load, thereby to prevent a flickering phenomenon caused by a change in the current.

The first passive bleeder circuit 24 is mainly used to provide a large triggering holding current in the case that the TRIAC dimmer 1 is just triggered to be in an on state. In this way, in the case that a dimming knob is rotated to a low position and the power is too low to provide a suitable holding current, it is able to prevent the TRIAC dimmer 1, which is just triggered to be in the on state, from being turned off, thereby to prevent the occurrence of the flickering phenomenon.

To be specific, the rectifier circuit 21 includes a first alternating voltage input end AI1 and a second alternating voltage input end AI2, and the alternating voltage from the TRIAC dimmer is inputted via the first alternating voltage input end AI1 and the second alternating voltage input end AI2.

Figure 3B:
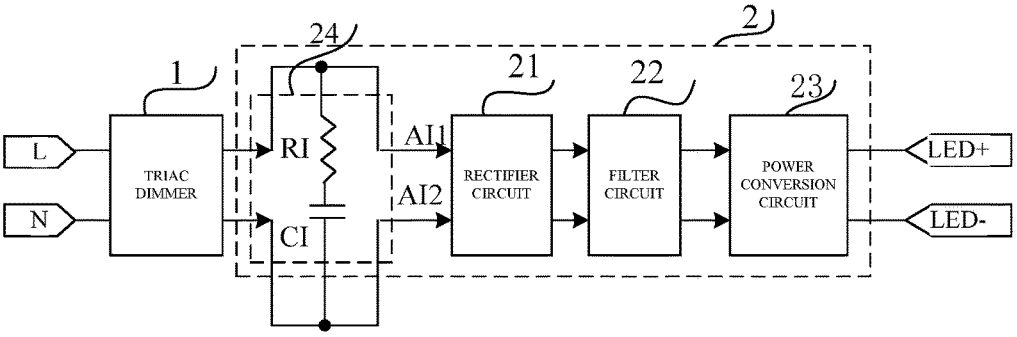
FIG. 3B is a circuit diagram of the LED dimming driver circuit according to one embodiment of the present disclosure.

As shown in FIG. 3B, the first passive bleeder circuit 24 includes: a first input resistor RI, a first end of which is connected to the first alternating voltage input end AI1; and an input capacitor CI, a first end of which is connected to a second end of the input resistor RI, and a second end of which is connected to the second alternating voltage input end AI2. In other words, the input resistor RI is connected in serial to the input capacitor CI and connected in parallel to the TRIAC dimmer 1.

In an optional embodiment of the present disclosure, the first passive bleeder circuit 24 includes a RC circuit consisting of the input resistor RI and the input capacitor CI.

An operating procedure of the first passive bleeder circuit will be described as follows. In the case that the TRIAC dimmer 1 is turned off, a voltage across the two ends of the input capacitor CI is 0. In the case that the TRIAC dimmer 1 is triggered to be turned on, an instantaneous peak current generated by the first passive bleeder circuit 24 is a value obtained through dividing a voltage at the triggering of the TRIAC dimmer 1 by a resistance of the input resistor RI. In terms of the dimming performance of the entire circuit, the larger the capacitance of the input capacitor CI, the better the dimmer effect. However, in the case of an excessive capacitance of the input capacitor CI, a dimming range of the circuit may be narrowed, so a compromise needs to be made. The input resistor RI is mainly provided so as to control the triggering peak current and its maintenance period, thereby to prevent from the TRIAC dimmer 1 from being burned out due to the large instantaneous current generated in the case that the TRIAC dimmer 1 is triggered. In addition, it is able to prevent the oscillation generated by the RC circuit and prevent the TRIAC dimmer from being turned off due to a negative input current, thereby to prevent the occurrence of the flickering phenomenon. Hence, a value of the resistance of the input resistor RI is very important.

To be specific, the input resistor RI may have a resistance ranging from 500Ω to 5000Ω, optionally 2000Ω or 3000Ω. The input capacitor CI may have a capacitance ranging from 47 nF to 220 nF, optionally 100 nF, 150 nF or 200 nF.

Figure 4A:
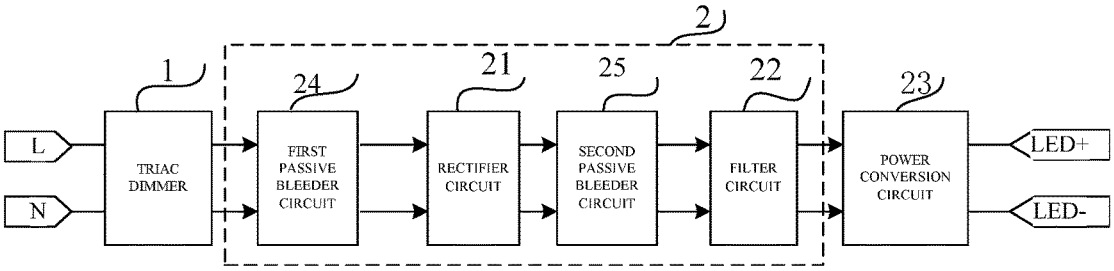
FIG. 4A is another circuit diagram of the LED dimming driver circuit according to one embodiment of the present disclosure.

To be specific, as shown in FIG. 4A, the RCC2 may further include a second passive bleeder circuit 25 arranged between the rectifier circuit 21 and the filter circuit 22 and configured to perform a passive bleeding operation on the direct voltage from the rectifier circuit 21.

In the embodiments of the present disclosure, through the second passive bleeder circuit 5 added between the rectifier circuit 21 and the filter circuit 22, it is able to provide a stable current for the LED load, thereby to prevent the occurrence of the flickering phenomenon due to a change in the current.

Figure 4B:
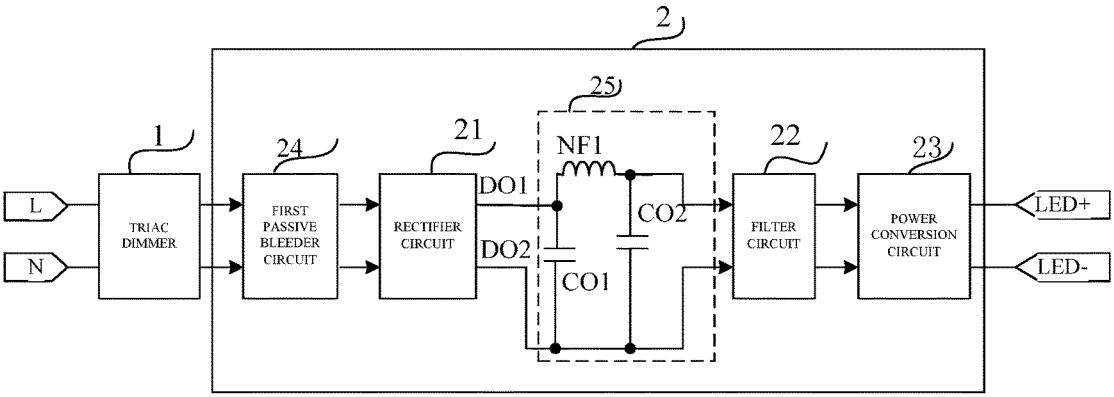
FIG. 4B is yet another circuit diagram of the LED dimming driver circuit according to one embodiment of the present disclosure.

To be specific, as shown in FIG. 4B, the rectifier circuit 21 includes a first direct voltage output end DO1 and a second direct voltage output end DO2, and the direct voltage rectified by the rectifier circuit 21 is outputted via the first direct voltage output end DO1 and the second direct voltage output end DO2.

The second passive bleeder circuit 25 includes a pi-type filter. The pi-type filter includes: a first output capacitor CO1 connected between the first direct voltage output end DO1 and the second direct voltage output end DO2; a first DM inductor NF1, a first end of which is connected to the first direct voltage output end DO1; and a second output capacitor CO2, a first end of which is connected to a second end of the DM inductor NF1, and a second end of which is connected to the second direct voltage end DO2.

In an alternative embodiment of the present disclosure, the second passive bleeder circuit 25 includes the pi-type filter. The second passive bleeder circuit 25 is mainly provided so as to, on one hand, prevent a high frequency effect of an output end on an input end, thereby to prevent the misoperation of the TRIAC dimmer, and on the other hand, provide a large peak current for the TRIAC dimmer after the rectification, i.e., at a direct current side.

Figure 5:
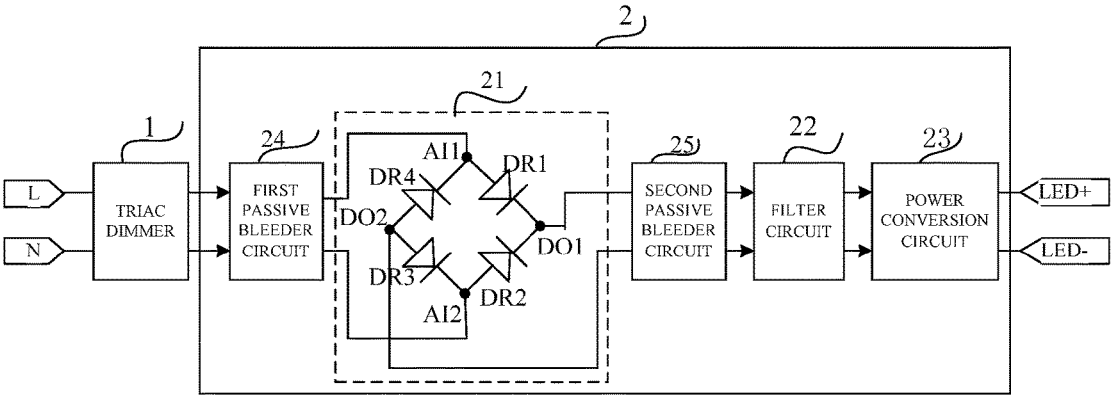
FIG. 5 is still yet another block diagram of the LED dimming driver circuit according to one embodiment of the present disclosure.

To be specific, as shown in FIG. 5, the rectifier circuit 21 includes a rectifier bridge. The rectifier bridge includes the first alternating voltage input end AI1, the second alternating voltage input end AI2, the first direct voltage output end DO1 and the second direct voltage output end DO2. The rectifier bridge further includes: a first rectifier diode DR1, an anode of which is connected to the first alternating voltage input end AI1, and a cathode of which is connected to the first direct voltage output end DO1; a second rectifier diode DR2, an anode of which is connected to the second alternating voltage input end AI2, and a cathode of which is connected to the cathode of the first rectifier diode DR1; a third rectifier diode DR3, an anode of which is connected to the second direct voltage output end DO2, and a cathode of which is connected to the cathode of the second rectifier diode DR2; and a fourth rectifier diode DR4, an anode of which is connected to the anode of the third rectifier diode DR3, and a cathode of which is connected to the anode of the first rectifier anode DR1.

The second passive bleeder circuit 25 is arranged downstream of the rectifier circuit 21, and at this time, the dimming range may not be adversely affected. Hence, the first output capacitor CO1 and the second output capacitor CO2 may each have a slightly larger capacitance that the input capacitor CI. Optionally, the CO1 and the CO2 may each have a capacitance ranging from 90 nF to 110 nF, e.g., 100 nF. The second rectifier diode DR2 and the third rectifier diode DR3 of the rectifier ridge of the rectifier circuit 21 are equivalent to a damping resistor for the first output capacitor CO1, and a direct current resistor (DCR) of the first DM inductor NF1 (i.e., a DCR of a coil of the first DM inductor NF1) is equivalent to a damping resistor of the second output capacitor CO2.

Figure 6:
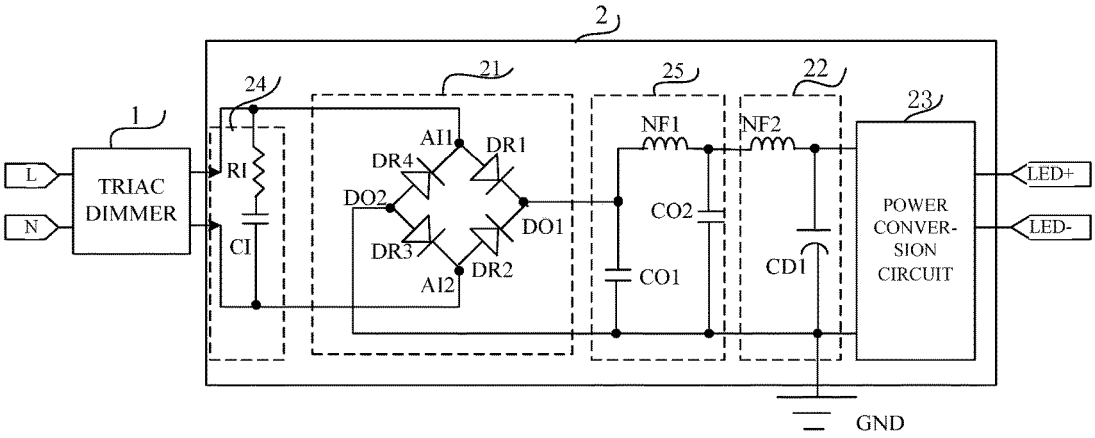
FIG. 6 is still yet another block diagram of the LED dimming driver circuit according to one embodiment of the present disclosure.

To be specific, as shown in FIG. 6, the filter circuit 22 includes: a filtration DM inductor NF2, a first end of which is connected to a second end of the first DM inductor NF1; and a filtration electrolytic capacitor CD1, a positive plate of which is connected to a second end of the filtration DM inductor NF2, and a negative plate of which is connected to the second direct voltage output end DO2.

In the filter circuit 22, the filtration electrolyte capacitor CD1 functions as to provide a suitable direct input voltage for a power supply, and this direct input voltage may not be too large. In the case of a too large direct input voltage, an input current may be smaller than the desired TRIAC holding current, thereby the flickering phenomenon may occur. In the case of a too small direct input voltage, the TRIAC dimmer may be damaged due to a too large input current. Hence, a value of the capacitance of the CD1 is important. Optionally, the CD1 may have a capacitance ranging from 0.68 μF to 2.2 μF, e.g., 1 μF. The filtration DM inductor NF2 mainly functions as to prevent the high frequency effect of the output end on the input end, and its capacitance may not be too large. To be specific, the capacitance of the NF2 may depend on the capacitance of the CD1, and it may range from 1 mH to 2 mH, e.g., 1.5 mH.

To be specific, the power conversion circuit includes a power protection electrolytic capacitor and a power protection resistor connected in parallel between the anode of the LED load and the cathode of the LED load.

The power protection resistor mainly functions as to divide the current passing through the LED load in the case of low power (less than 1 W), so as to enable the LED load not to operate at a weak current, thereby to prevent the occurrence of the flickering phenomenon at a low end. The power protection electrolytic capacitor mainly functions as to improve of a ripple current, so a capacitance of the power protection electrolytic capacitor may not be too small. In the case of a too small capacitance, a too large change in the output voltage may be provided, and thereby the flickering phenomenon may occur. Hence, it is necessary to ensure that the voltage is substantially not changed within 10 ms. The power protection electrolytic capacitor may have a capacitance ranging from 82 μF to 220 μF, optionally 100 μF, 150 μF or 200 μF. For example, the power protection electrolytic capacitor may have a capacitance ranging from 195 μF to 205 μF, optionally 200 μF.

As shown in FIG. 6, the second direct voltage output end DO2 is connected to the ground GND.

Figure 7:
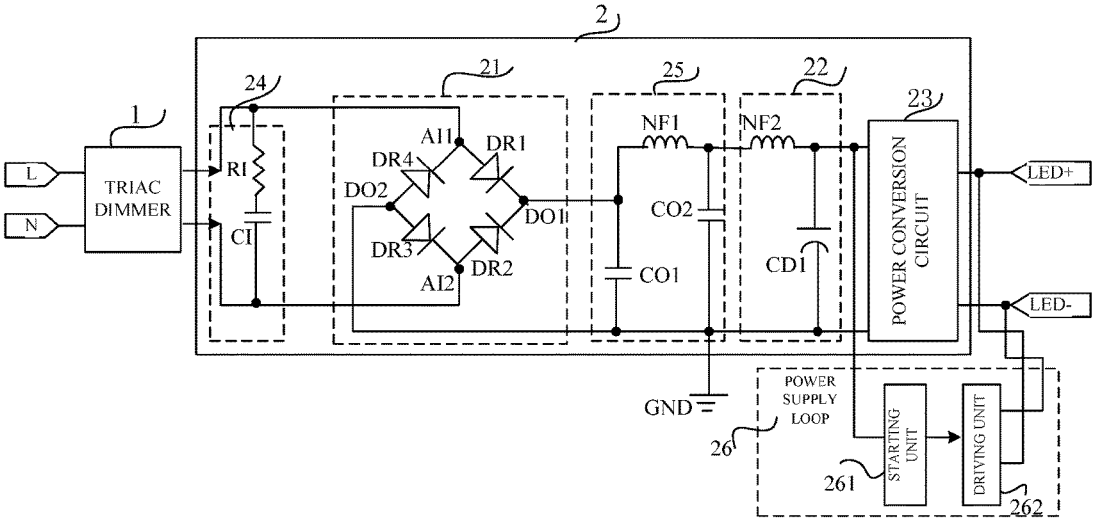
FIG. 7 is still yet another circuit diagram of the LED dimming driver circuit according to one embodiment of the present disclosure.

To be specific, as shown in FIG. 7, the LED dimming driver circuit further includes a power supply loop 26. The power supply loop 26 includes: a starting unit 261 connected to the filter circuit 22 and configured to convert the direct voltage filtered by the filter circuit 22 into a starting voltage; and a driving unit 262 connected to the starting unit 261 and the LED load and configured to perform positive feedback self-excited oscillation in accordance with the starting voltage, so as to provide the driving current for the LED load.

Figure 8A:
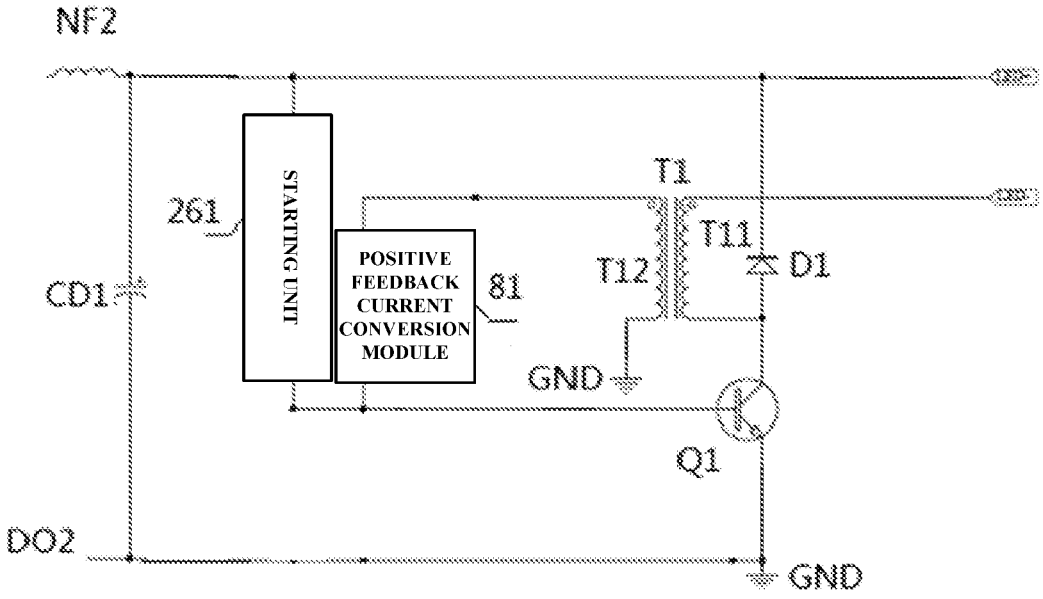
FIG. 8A is a circuit diagram of a power-supply loop of a RCC of the LED dimming driver circuit according to one embodiment of the present disclosure.

To be specific, as shown in FIG. 8A, the driving unit 262 includes a power-supply diode D1, a first switch transistor Q1, a positive feedback current conversion module 81, and a transformer T1 having a primary winding T11 and a secondary winding T12. A cathode of the power-supply diode D1 is connected to the second end of the filtration DM inductor NF2 and the anode (LED+) of the LED load. A control electrode of the first switch transistor Q1 is connected to the second end of the filtration DM inductor NF2 through the starting unit 261, a first electrode thereof is connected to an anode of the power-supply diode D1, and a second electrode thereof is connected to the second direct voltage output end DO2. A first end of the primary winding T11 is connected to the cathode (LED−) of the LED load, and a second end thereof is connected to the first electrode of the first switch transistor Q1. A first end of the secondary winding T12 is connected to the control electrode of the first switch transistor Q1 through the positive feedback current conversion module 81, and a second end thereof is grounded. The positive feedback current conversion module 81 is configured to convert an induced electromotive force generated by the secondary winding T12 into a positive feedback current, and input the positive feedback current to the control electrode of the first switch transistor Q1. In the case that the first switch transistor Q1 is turned on, the primary winding T11 is configured to provide the driving current to the LED load through the first switch transistor Q1 and the filtration electrolytic capacitor CD1, and in the case that the first switch transistor Q1 is turned off, the primary winding T11 is configured to provide the driving current to the LED load through the power-supply diode D1.

In FIG. 8A, the first switch transistor Q1 is a triode. The control electrode of the first switch transistor Q1 is a base, the first electrode thereof is a collector, and the second electrode thereof is an emitter. However, in some other embodiments of the present disclosure, the first switch transistor Q1 may also be in any other kinds, and the second direct voltage output end A02 is connected to the ground GND.

Figure 8B:
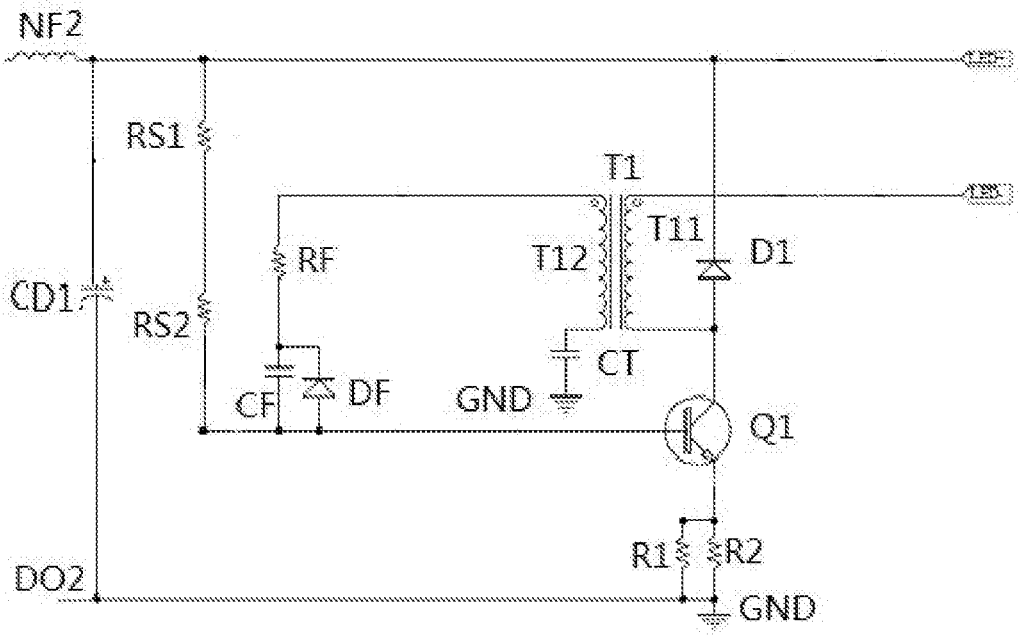
FIG. 8B is another circuit diagram of the power-supply loop of the RCC of the LED dimming driver circuit according to one embodiment of the present disclosure.

To be specific, as shown in FIG. 8B, the positive feedback current conversion module 81 includes: a feedback resistor RF, a first end of which is connected to the first end of the secondary winding T12; and a feedback capacitor CF, a first end of which is connected to a second end of the feedback resistor RF, and a second end of which is connected to the control electrode of the first switch transistor Q1. The driving unit may further include a transmission capacitor CT, and the second end of the secondary winding T12 is connected to the ground GND through the transmission capacitor CT.

Optionally, as shown in FIG. 8B, the positive feedback current conversion module 81 further includes a feedback diode DF, an anode of which is connected to the control electrode of the first switch transistor Q1, and a cathode of which is connected to the first end of the feedback capacitor.

In FIG. 8B, the starting unit includes a first resistor module, which includes a first starting resistor RS1 and a second starting resistor RS2 connected in serial to each other. The driving unit further includes a second resistor module connected between the second electrode of the first switch transistor Q1 and the second direct voltage output end DO2. The second resistor module includes a first resistor R1 and a second resistor R2 connected in parallel to each other.

The power supply loop in FIG. 8B may include two procedures during the power supply.

1. Before the Q1 is turned on, no oscillation occurs for the power supply loop.

2. After the Q1 is turned on, oscillation occurs for the power supply loop. To be specific, upon the RCC is powered on, a voltage across the CD1 may increase instantaneously, and then be transmitted to the base of the Q1 through the RS1 and the RS2, so as to turn on the Q1. At this time, the LED load is powered on through the Q1, the R1 and R2 connected in parallel to each other, and the CD1. In addition, due to a current IC generated by the collector and the emitter of the Q1, an induced electromotive force may be generated by the T1. The secondary winding T12 of the T1 is connected to the base of the Q1 through the RF and the CF, so as to increase the current IC generated between the collector and the emitter of the Q1, thereby to form positive feedback in the power supply loop, until the Q1 exits from an oversaturation state and enters an amplification region. Then, the Q1 is turned off at a cut-off region, and the primary winding T11 of the T1 is configured to supply power to the LED load through the D1, and the power supply loop enters a dynamic balancing state. Next, the Q1 may be turned on again after the completion of the discharging of the primary winding T11 of the T1 toward the LED load.

To be specific, the power supply loop further includes a current-limiting protection unit connected to the first end of the secondary winding and the control electrode of the first switch transistor, and configured to control the first switch transistor to be in an off state in the case that a potential at the first end of the secondary winding is greater than a predetermined value, so as to limit a load current. The potential at the first end of the secondary winding varies along with the direct voltage from the rectifier circuit, i.e., the current-limiting protection unit is configured to limit the fluctuation of the direct voltage.

Figure 8C:
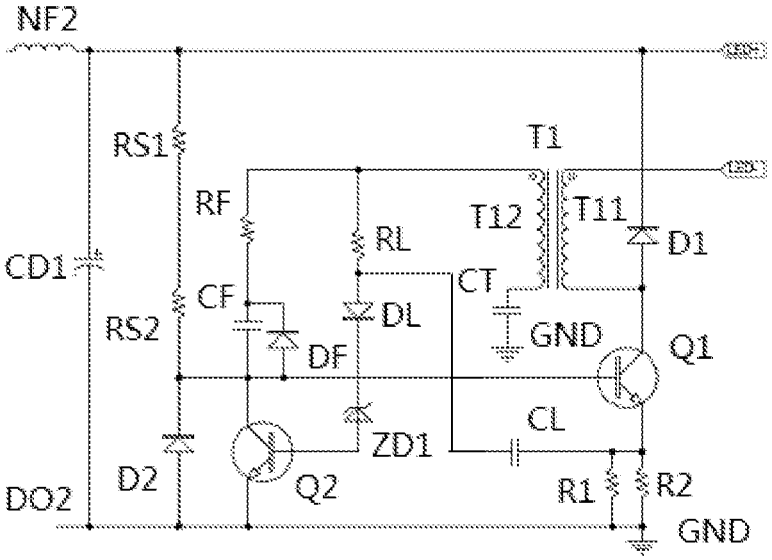
FIG. 8C is yet another circuit diagram of the power-supply loop of the RCC of the LED dimming driver circuit according to one embodiment of the present disclosure.

To be specific, as shown in FIG. 8C, the current-limiting protection unit includes a second switch transistor Q2, a voltage-stabilizing diode ZD1, a current-limiting diode DL, a current-limiting capacitor CL and a current-limiting resistor RL. A first end of the current-limiting resistor RL is connected to the first end of the secondary winding T12. An anode of the current-limiting diode DL is connected to a second end of the current-limiting resistor RL. A cathode of the voltage-stabilizing diode ZD1 is connected to a cathode of the current-limiting diode DL. A first end of the current-limiting capacitor CL is connected to the anode of the current-limiting diode DL, and a second end thereof is connected to the second electrode of the first switch transistor Q1. A control electrode of the second switch transistor Q2 is connected to an anode of the voltage-stabilizing diode ZD1, a first electrode thereof is connected to the control electrode of the first switch transistor Q1, and a second electrode thereof is connected to the second direct voltage output end.

In FIG. 8C, the second switch transistor Q2 may be a triode. The control electrode of the second switch transistor Q2 is a base, the first electrode thereof is a collector and the second electrode thereof is an emitter. However, in some other embodiments of the present disclosure, the second switch transistor Q2 may also be in any other kinds.

Optionally, as shown in FIG. 8C, the current-limiting protection unit further includes a collection-emission diode D2, an anode of which is connected to the second electrode (i.e., the emitter) of the second switch transistor Q2, and a cathode of which is connected to the first electrode (i.e., the collector) of the second switch transistor Q2.

To be specific, during the operation of the power supply loop as shown in FIG. 8C, the fluctuation of the input alternating voltage may be reflected in the secondary winding T12 of the T1. In the case that the voltage across the two ends of the secondary winding T12 is greater than a predetermined voltage, the Q2 may be turned on and the Q1 may be turned off, so as to limit the fluctuation of the input alternating voltage. However, the RL and the CL may function as buffering units. The voltage across the two ends of the CL may not change suddenly, i.e., it may take a certain time period for the voltage to increase, so there may exist a certain time delay.

Figure 8D:
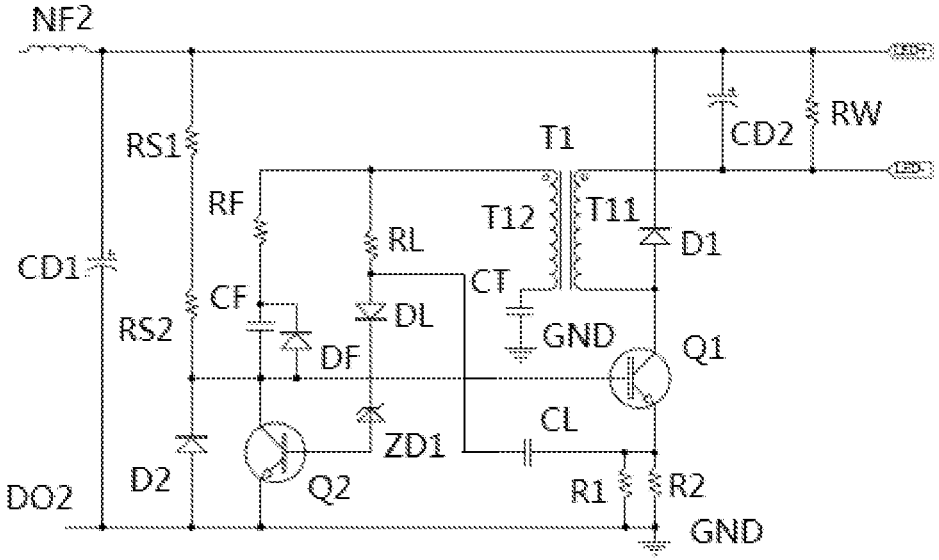
FIG. 8D is still yet another circuit diagram of the power-supply loop of the RCC of the LED dimming driver circuit according to one embodiment of the present disclosure.

To be specific, as shown in FIG. 8D, a power conversion circuit may be arranged between the anode (LED+) of the LED load and the cathode (LED−) of the LED load. The power conversion circuit includes a power protection electrolytic capacitor CD2 and a power protection resistor RW connected in parallel between the anode (LED+) of the LED load and the cathode (LED−) of the LED load. A positive plate of the CD2 is connected to the anode (LED+) of the LED load, and a negative plate thereof is connected to the cathode (LED−) of the LED load.

The CD2 may be charged and discharged. In the case that the CD2 is charged, a direct current with a high-frequency alternating current component may be supplied to the CD2, and in the case that the CD2 is discharged toward the LED load, a constant direct current may be supplied from the CD2. In this way, the high-frequency alternating current component may be removed, so as to achieve the power conversion. The RW may function as to release superfluous charges stored in the CD2 in the case that the input alternating voltage is very small, so as to prevent the charges from being accumulated to reach a threshold voltage of the LED load, thereby to prevent the occurrence of the flickering phenomenon. At this time, the RW is equivalent to a bypass resistor for the LED load.

The LED dimming driving circuit will be described hereinafter in conjunction with an alternative embodiment.

Figure 9:
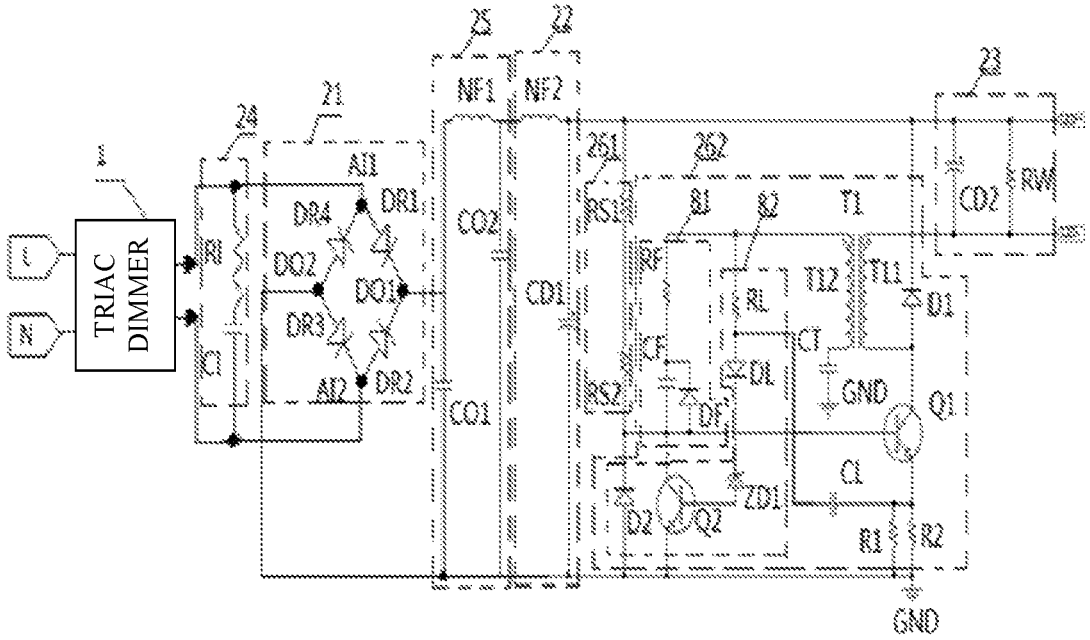
FIG. 9 is a schematic view showing the LED dimming driver circuit according to one embodiment of the present disclosure.

As shown in FIG. 9, the LED dimming driver circuit includes: a TRIAC dimmer 1 configured to adjust an inputted alternating voltage; and a RCC connected to the TRIAC dimmer 1 and configured to adjust the alternating voltage from the TRIAC dimmer 1 so as to provide a driving current for an LED load.

To be specific, the LED dimming driver circuit in FIG. 9 may be a straight pipe made of glass and having an 18 W built-in dimming LED.

In FIG. 9, a reference sign L represents a live line for a mains supply capable of providing an alternating voltage, and a reference sign N represents a neutral line for the mains supply. A reference sign LED+ represents an anode of the LED load, and a reference sign LED− represents a cathode of the LED load.

The RCC includes: a rectifier circuit 21 configured to rectify the alternating voltage from the TRIAC dimmer 1 into a direct voltage; a filter circuit 22 configured to filter the direct voltage; a power conversion circuit 23 configured to perform power conversion on the filtered direct voltage, so as to filter out an alternating voltage component from the filtered direct voltage, thereby to provide the driving current for the LED load; a first passive bleeder circuit 24 arranged between the TRIAC dimmer 1 and the rectifier circuit 21 and configured to perform a passive bleeding operation on the alternative voltage from the TRIAC dimmer 1; a second passive bleeder circuit 25 arranged between the rectifier circuit 21 and the filter circuit 22 and configured to perform a passive bleeding operation on the direct voltage from the rectifier circuit 21; and a power supply loop 26.

The power supply loop 26 includes: a starting unit 261 connected to the filter circuit 22 and configured to convert the direct voltage filtered by the filter circuit 22 into a starting voltage; and a driving unit 262 connected to the starting unit 261 and the LED load and configured to perform positive feedback self-excited oscillation in accordance with the starting voltage, so as to provide the driving current for the LED load.

The elements of the functional circuits of the LED dimming driver circuit will be described hereinafter. The rectifier circuit 21 includes a first alternating voltage input end AI1, a second alternating voltage input end AI2, a first direct voltage output end DO1 and a second direct voltage output end DO2. The rectifier bridge further includes: a first rectifier diode DR1, an anode of which is connected to the first alternating voltage input end AI1, and a cathode of which is connected to the first direct voltage output end DO1; a second rectifier diode DR2, an anode of which is connected to the second alternating voltage input end AI2, and a cathode of which is connected to the cathode of the first rectifier diode DR1; a third rectifier diode DR3, an anode of which is connected to the second direct voltage output end DO2, and a cathode of which is connected to the cathode of the second rectifier diode DR2; and a fourth rectifier diode DR4, an anode of which is connected to the anode of the third rectifier diode DR3, and a cathode of which is connected to the anode of the first rectifier anode DR1.

The filter circuit 22 includes: a filtration DM inductor NF2, a first end of which is connected to a second end of the first DM inductor NF1; and a filtration electrolytic capacitor CD1, a positive plate of which is connected to a second end of the filtration DM inductor NF2, and a negative plate of which is connected to the second direct voltage output end DO2.

The power conversion circuit 23 includes a power protection electrolytic capacitor CD2 and a power protection resistor RW connected in parallel between the anode (LED+) of the LED load and the cathode (LED−) of the LED load. A positive plate of the CD2 is connected to the anode (LED+), and a negative plate of the CD2 is connected to the cathode (LED−).

The first passive bleeder circuit 24 includes: a first input resistor RI, a first end of which is connected to the first alternating voltage input end AI1; and an input capacitor CI, a first end of which is connected to a second end of the input resistor RI, and a second end of which is connected to the second alternating voltage input end AI2.

The second passive bleeder circuit 25 includes a pi-type filter. The pi-type filter includes: a first output capacitor CO1 connected between the first direct voltage output end DO1 and the second direct voltage output end DO2; a first DM inductor NF1, a first end of which is connected to the first direct voltage output end DO1; and a second output capacitor CO2, a first end of which is connected to a second end of the DM inductor NF1, and a second end of which is connected to the second direct voltage end DO2.

The starting unit 261 includes a first starting resistor RS1 and a second starting resistor RS2. A first end of the first starting resistor RS1 is connected to the second end of the filtration DM inductor NF2, and a second end thereof is connected to a first end of the second starting resistor RS2.

The driving unit 262 includes a power-supply diode D1, a first switch transistor Q1, a positive feedback current conversion module 81, a transmission capacitor CT, a second resistor module, and a transformer T1 having a primary winding T11 and a secondary winding T12. A cathode of the power-supply diode D1 is connected to the second end of the filtration DM inductor NF2 and the anode (LED+) of the LED load. The first switch transistor Q1 is a triode. A base of the first switch transistor Q1 is connected to a second of the second starting resistor RS2, a collector thereof is connected to the anode of the power-supply diode D1, and an emitter thereof is connected to the second direct voltage output end DO2 through the second resistor module. The second resistor module includes a first resistor R1 and a second resistor R2 connected in parallel. A first end of the primary winding T11 is connected to the cathode (LED−) of the LED load, and a second thereof is connected to the first electrode of the first switch transistor D1. A first end of the secondary winding T12 is connected to the control electrode of the first switch transistor Q1 through the positive feedback current conversion module 81, and a second end thereof is grounded through the transmission capacitor CT. The positive feedback current conversion module 81 is configured to convert an induced electromotive force generated by the secondary winding T12 into a positive feedback current, and input the positive feedback current to the base of the first switch transistor Q1. In the case that the first switch transistor Q1 is turned on, the primary winding T11 is configured to provide the driving current to the LED load through the first switch transistor Q1 and the filtration electrolytic capacitor CD1, and in the case that the first switch transistor Q1 is turned off, the primary winding T11 is configured to provide the driving current to the LED load through the power-supply diode D1.

The positive feedback current conversion module 81 includes: a feedback resistor RF, a first end of which is connected to the first end of the secondary winding T12; a feedback capacitor CF, a first end of which is connected to a second end of the feedback resistor RF, and a second end of which is connected to the control electrode of the first switch transistor Q; and a feedback diode DF, an anode of which is connected to the base of the first switch transistor Q1, and a cathode of which is connected to the first end of the feedback capacitor.

The power supply loop further includes a current-limiting protection unit 82 connected to the first end of the secondary winding T12 and the base of the first switch transistor Q1, and configured to control the first switch transistor Q1 to be in an off state in the case that a potential at the first end of the secondary winding T12 is greater than a predetermined value, so as to limit a load current. The potential at the first end of the secondary winding T12 varies along with the direct voltage from the rectifier circuit 22, i.e., the current-limiting protection unit 82 is configured to limit the fluctuation of the direct voltage.

The current-limiting protection unit 82 includes a second switch transistor Q2, a voltage-stabilizing diode ZD1, a current-limiting diode DL, a current-limiting capacitor CL, a current-limiting resistor RL, and a collection-emission diode D2. The second switch transistor Q2 is a triode. A first end of the current-limiting resistor RL is connected to the first end of the secondary winding T12. An anode of the current-limiting diode DL is connected to a second end of the current-limiting resistor RL. A cathode of the voltage-stabilizing diode ZD1 is connected to a cathode of the current-limiting diode DL. A first end of the current-limiting capacitor CL is connected to the anode of the current-limiting diode DL, and a second end thereof is connected to the emitter of the first switch transistor Q1. A base of the second switch transistor Q2 is connected to an anode of the voltage-stabilizing diode ZD1, a collector thereof is connected to the base of the first switch transistor Q1, and an emitter thereof is connected to the second direct voltage output end. An anode of the collection-emission diode D2 is connected to the emitter of the second switch transistor Q2, and a cathode thereof is connected to the collector of the second switch transistor Q2.

FIG. 9 is a schematic view showing the entire LED dimming driver circuit according to one embodiment of the present disclosure.

The LED dimming driver circuit in the embodiments of the present disclosure includes the RCC for the LED dimming. Because the RCC is a self-excited topology-driven circuit, as compared with a conventional separately-excited circuit, the RCC is simple and cheap and has high conversion efficiency. In addition, due to its characteristics, it is able for the RCC to convert, in a nearly linear manner, a change in an input voltage applied to the TRIAC dimmer into a change in an output current. The starting voltage desired for the RCC is usually very low, and even in the case that the inputted alternating voltage is very low, the RCC may operate normally too. As a result, it is able to increase a dimming range.

In addition, for the LED dimming driver circuit in the embodiments of the present disclosure, the output current may be smoothed through adding the first passive bleeder circuit and the second passive bleeder circuit upstream and downstream of the rectifier circuit respectively, adding a blanking resistor at a side of the LED load, and increasing the capacitance of the electrolytic energy-storage capacitor. As a result, it is able to provide a stable current for the LED load (e.g., an LED bead), thereby to prevent the occurrence of the flickering phenomenon due to the change in the output current.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present.

What is claimed is:

1. A light-emitting diode (LED) dimming driver circuit, comprising:

a triode-for-alternating-current (TRIAC) dimmer configured to adjust an inputted alternating voltage; and a ringing choke converter (RCC) connected to the TRIAC dimmer and configured to adjust the alternating voltage from the TRIAC dimmer to provide a driving current for an LED load, wherein the RCC at least comprises:

a rectifier circuit configured to rectify the alternating voltage from the TRIAC dimmer into a direct voltage;

a filter circuit configured to filter the direct voltage; and a power conversion circuit configured to perform power conversion on the filtered direct voltage to filter out an alternating voltage component from the filtered direct voltage, thereby to provide the driving current for the LED load, and wherein the RCC further comprises a first passive bleeder circuit arranged between the TRIAC dimmer and the rectifier circuit and configured to perform a passive bleeding operation on the alternative voltage from the TRIAC dimmer.

2. The LED dimming driver circuit according to claim 1, wherein the rectifier circuit comprises a first alternating voltage input end and a second alternating voltage input end, and the alternating voltage from the TRIAC dimmer is inputted via the first alternating voltage input end and the second alternating voltage input end, wherein the first passive bleeder circuit comprises:

an input resistor, a first end of which is connected to the first alternating voltage input end; and an input capacitor, a first end of which is connected to a second end of the input resistor, and a second end of which is connected to the second alternating voltage input end.

3. The LED dimming driver circuit according to claim 2, wherein the input resistor has a resistance ranging from 500Ω to 5000Ω, and the input capacitor has a capacitance ranging from 47 nF to 220 nF.

4. The LED dimming driver circuit according to claim 1, wherein the RCC further comprises a second passive bleeder circuit arranged between the rectifier circuit and the filter circuit and configured to perform a passive bleeding operation on the direct voltage from the rectifier circuit.

5. The LED dimming driver circuit according to claim 4, wherein the rectifier circuit comprises a first direct voltage output end and a second direct voltage output end, and the direct voltage rectified by the rectifier circuit is outputted via the first direct voltage output end and the second direct voltage output end;

the second passive bleeder circuit comprises a pi-type filter; and the pi-type filter comprises:

a first output capacitor connected between the first direct voltage output end and the second direct voltage output end;

a first differential mode (DM) inductor, a first end of which is connected to the first direct voltage output end; and a second output capacitor, a first end of which is connected to a second end of the DM inductor, and a second end of which is connected to the second direct voltage end.

6. The LED dimming driver circuit according to claim 5, wherein the first output capacitor and the second output capacitor each have a capacitance ranging from 90 nF to 110 nF.

7. The LED dimming driver circuit according to claim 6, wherein the rectifier circuit comprises a first alternating voltage input end and a second alternating voltage input end, and wherein the rectifier circuit comprises a rectifier bridge; and the rectifier bridge comprises:

a first rectifier diode, an anode of which is connected to the first alternating voltage input end, and a cathode of which is connected to the first direct voltage output end;

a second rectifier diode, an anode of which is connected to the second alternating voltage input end, and a cathode of which is connected to the cathode of the first rectifier diode;

a third rectifier diode, an anode of which is connected to the second direct voltage output end, and a cathode of which is connected to the cathode of the second rectifier diode; and a fourth rectifier diode, an anode of which is connected to the anode of the third rectifier diode, and a cathode of which is connected to the anode of the first rectifier anode.

8. The LED dimming driver circuit according to claim 7, wherein the filter circuit comprises:

a filtration DM inductor, a first end of which is connected to a second end of the first DM inductor; and a filtration electrolytic capacitor, a positive plate of which is connected to a second end of the filtration DM inductor, and a negative plate of which is connected to the second direct voltage output end.

9. The LED dimming driver circuit according to claim 8, wherein the filtration DM inductor has an inductance ranging from 1 mH to 2 mH, and the filtration electrolytic capacitor has a capacitance ranging from 0.68 μF to 2.2 μF.

10. The LED dimming driver circuit according to claim 8, wherein the RCC further comprises a power supply loop, and the power supply loop comprises:

a starting unit connected to the filter circuit and configured to convert the direct voltage filtered by the filter circuit into a starting voltage; and a driving unit connected to the starting unit and the LED load and configured to perform positive feedback self-excited oscillation in accordance with the starting voltage to provide the driving current for the LED load.

11. The LED dimming driver circuit according to claim 10, wherein the driving unit comprises a power-supply diode, a first switch transistor, a positive feedback current conversion module, and a transformer having a primary winding and a secondary winding;

a cathode of the power-supply diode is connected to the second end of the filtration DM inductor and an anode of the LED load;

a control electrode of the first switch transistor is connected to the second end of the filtration DM inductor through the starting unit, a first electrode of the first switch transistor is connected to an anode of the power-supply diode, and a second electrode of the first switch transistor is connected to the second direct voltage output end;

a first end of the primary winding is connected to a cathode of the LED load, and a second end of the primary winding is connected to the first electrode of the first switch transistor; and a first end of the secondary winding is connected to the control electrode of the first switch transistor through the positive feedback current conversion module, and a second end of the secondary winding is grounded;

the positive feedback current conversion module is configured to convert an induced electromotive force generated by the secondary winding into a positive feedback current, and input the positive feedback current to the control electrode of the first switch transistor; and in the case that the first switch transistor is turned on, the primary winding is configured to provide the driving current to the LED load through the first switch transistor and the filtration electrolytic capacitor, and in the case that the first switch transistor is turned off, the primary winding is configured to provide the driving current to the LED load through the power-supply diode.

12. The LED dimming driver circuit according to claim 11, wherein the starting unit comprises a first resistor module, and the driving unit further comprises a second resistor module connected between the second electrode of the first switch transistor and the second direct voltage output end.

13. The LED dimming driver circuit according to claim 11, wherein the positive feedback current conversion module comprises:

a feedback resistor, a first end of which is connected to the first end of the secondary winding; and a feedback capacitor, a first end of which is connected to a second end of the feedback resistor, and a second end of which is connected to the control electrode of the first switch transistor, and the power-supply loop further comprises a transmission capacitor, and the second end of the secondary winding is grounded through the transmission capacitor.

14. The LED dimming driver circuit according to claim 13, wherein the positive feedback current conversion module further comprises a feedback diode, an anode of which is connected to the control electrode of the first switch transistor, and a cathode of which is connected to the first end of the feedback capacitor.

15. The LED dimming driver circuit according to claim 11, wherein the power-supply loop further comprises a current-limiting protection unit connected to the first end of the secondary winding and the control electrode of the first switch transistor, and configured to control the first switch transistor to be in an off state in the case that a potential at the first end of the secondary winding is greater than a predetermined value to limit a load current.

16. The LED dimming driver circuit according to claim 15, wherein the current-limiting protection unit comprises a second switch transistor, a voltage-stabilizing diode, a current-limiting diode, a current-limiting capacitor and a current-limiting resistor;

a first end of the current-limiting resistor is connected to the first end of the secondary winding;

an anode of the current-limiting diode is connected to a second end of the current-limiting resistor;

a cathode of the voltage-stabilizing diode is connected to a cathode of the current-limiting diode;

a first end of the current-limiting capacitor is connected to the anode of the current-limiting diode, and a second end of the current-limiting capacitor is connected to the second electrode of the first switch transistor; and a control electrode of the second switch transistor is connected to an anode of the voltage-stabilizing diode, a first electrode of the second switch transistor is connected to the control electrode of the first switch transistor, and a second electrode of the second switch transistor is connected to the second direct voltage output end.

17. The LED dimming driver circuit according to claim 11, wherein the power protection circuit comprises a power protection electrolytic capacitor and a power protection resistor connected in parallel between the anode of the LED load and the cathode of the LED load.

18. The LED dimming driver circuit according to claim 17, wherein the power protection electrolytic capacitor has a capacitance ranging from 82 μF to 220 μF.

19. A light-emitting diode (LED) dimming driver circuit, comprising:

a triode-for-alternating-current (TRIAC) dimmer configured to adjust an inputted alternating voltage; and a ringing choke converter (RCC) connected to the TRIAC dimmer and configured to adjust the alternating voltage from the TRIAC dimmer to provide a driving current for an LED load, wherein the RCC at least comprises:

a rectifier circuit configured to rectify the alternating voltage from the TRIAC dimmer into a direct voltage;

a filter circuit configured to filter the direct voltage; and a power conversion circuit configured to perform power conversion on the filtered direct voltage to filter out an alternating voltage component from the filtered direct voltage, thereby to provide the driving current for the LED load, and wherein the RCC further comprises a power supply loop, and the power supply loop comprises:

a starting unit connected to the filter circuit and configured to convert the direct voltage filtered by the filter circuit into a starting voltage; and a driving unit connected to the starting unit and the LED load and configured to perform positive feedback self-excited oscillation in accordance with the starting voltage to provide the driving current for the LED load.

20. The LED dimming driver circuit according to claim 19, wherein the rectifier circuit comprises a first direct voltage output end and a second direct voltage output end, the second passive bleeder circuit comprises a first differential mode (DM) inductor, a first end of which is connected to the first direct voltage output end, wherein the filter circuit comprises:

a filtration DM inductor, a first end of which is connected to a second end of the first DM inductor; and a filtration electrolytic capacitor, a positive plate of which is connected to a second end of the filtration DM inductor, and a negative plate of which is connected to the second direct voltage output end, and wherein the driving unit comprises a power-supply diode, a first switch transistor, a positive feedback current conversion module, and a transformer having a primary winding and a secondary winding;

a cathode of the power-supply diode is connected to the second end of the filtration DM inductor and an anode of the LED load;

a control electrode of the first switch transistor is connected to the second end of the filtration DM inductor through the starting unit, a first electrode of the first switch transistor is connected to an anode of the power-supply diode, and a second electrode of the first switch transistor is connected to the second direct voltage output end;

a first end of the primary winding is connected to a cathode of the LED load, and a second end of the primary winding is connected to the first electrode of the first switch transistor; and a first end of the secondary winding is connected to the control electrode of the first switch transistor through the positive feedback current conversion module, and a second end of the secondary winding is grounded;

the positive feedback current conversion module is configured to convert an induced electromotive force generated by the secondary winding into a positive feedback current, and input the positive feedback current to the control electrode of the first switch transistor; and in the case that the first switch transistor is turned on, the primary winding is configured to provide the driving current to the LED load through the first switch transistor and the filtration electrolytic capacitor, and in the case that the first switch transistor is turned off, the primary winding is configured to provide the driving current to the LED load through the power-supply diode.

* * * * *